US006026670A

United States Patent [19]

Woulds

[11] Patent Number: 6,026,670

[45] Date of Patent: Feb. 22, 2000

[54] APPARATUS FOR USE IN FORMING CAN BODIES

[75] Inventor: William Woulds, Shipley, United Kingdom

[73] Assignee: Crown Cork & Seal Technologies Corporation, Alsip, Ill.

[21] Appl. No.: 09/205,730

[22] Filed: Dec. 4, 1998

[30] Foreign Application Priority Data

Dec. 5, 1997 [GB] United Kingdom ..... 9725677

[51] Int. Cl.[7] ..... B21D 45/08

[52] U.S. Cl. ..... 72/345

[58] Field of Search ..... 72/344, 345, 348

[56] References Cited

U.S. PATENT DOCUMENTS

| | | | |
|---|---|---|---|
| 3,771,344 | 11/1973 | Wright . | |
| 4,164,860 | 8/1979 | Kaminskas | 72/345 |
| 4,224,819 | 9/1980 | Kaminskas . | |
| 5,056,350 | 10/1991 | Moen et al. . | |

FOREIGN PATENT DOCUMENTS 2268898 6/1993 United Kingdom .

OTHER PUBLICATIONS

EP Search Report GB9725677.0.

*Primary Examiner*—Lowell A. Larson
*Attorney, Agent, or Firm*—Diller, Ramik & Wight, PC

[57] ABSTRACT

Apparatus for use in forming can bodies comprises a punch including a hollow punch sleeve with a supply of compressed air connected to the interior thereof. A concave dome void recess in the nose of the punch is adapted to receive a correspondingly shaped doming tool for forming a domed base profile in the can body and an air passage provides fluid communication between the interior of the punch sleeve and the concave recess. A valve located in the air passage is biased into the open position by a spring but is normally held closed by the pressure of air in the interior of the sleeve. Entry of the doming tool into the dome void recess when the valve is closed causes a substantial rise in pressure in the air passage which enables the valve to open and deliver compressed air to the interior of the can body to assist in stripping it from the punch.

8 Claims, 1 Drawing Sheet

1
2
3
4
5
6
7
8
81
82
9
10
11
12
13
14
15
16
17
18
B
W

APPARATUS FOR USE IN FORMING CAN BODIES

FIELD OF THE INVENTION

The invention relates to apparatus for use in forming can bodies and in particular relates to apparatus for assisting in the stripping of can bodies from the punch of a can body-maker.

BACKGROUND TO THE INVENTION

It is well known that the interior of a can body must be supplied with a charge of compressed air during stripping from the body maker punch to avoid collapse of the can body. The need for a compressed air charge stems from the formation of a vacuum as the male punch tool is rapidly withdrawn from the can body. This vacuum would collapse the can body were it not for the timely delivery of a small charge of compressed air. Furthermore, it is believed that the compressed air assists with the removal of the can body by pushing the body off the end of the tool and also slightly expanding the body by virtue of hoop stresses set up by the hydrostatic pressure, thus relieving some friction between can and tool.

In one known apparatus, the air supply from the factory main is, following conditioning, passed to a pilot assisted electronic shuttle via an air receiver. The shuttle valve is controlled by an Autotech controller. Because of the delays in reaction time for the valve and the propagation time along the pipe lines, the point in the cycle at which the signal needs to be sent is dependent on the machine speed. At 500 cans per minute the advance in the signal timing can amount to about 165 degrees of crank movement. The opening response time of the valves is not constant and a safety margin has to be incorporated into the advance timing.

In another apparatus, known from GB-A-2268898 a mechanical valve located in the punch sleeve is opened by the doming tool for the base profile of the can body and re-closed as the punch is withdrawn by virtue of its inertia.

SUMMARY OF THE INVENTION

It is proposed that an alternative method of air delivery be sought and to this end a pressure controlled device is provided by the present invention.

The present invention provides apparatus for use in forming can bodies comprising: a punch including a hollow punch sleeve; a supply of compressed air connected to the interior of the punch sleeve; a concave recess in the nose of the punch adapted to receive a complementary shaped doming tool for forming a domed base profile in the can body; an air passage providing fluid communication between the interior of the punch sleeve and the concave recess; and a valve located in the air passage; the valve being biased into the open position; wherein the volume of the air passage between the valve and the recess and the volume of the recess are such that entry of the doming tool into the recess when the valve is closed will cause a substantial rise in pressure in the air passage between the valve and the recess; and wherein the valve is constructed such that it causes a restriction to the flow of air in the air passage from the interior of the punch sleeve to the recess resulting in a pressure drop across the valve which acts on the valve in the direction tending to close the valve.

The system will use less air than known strippers. Economy in air use emerges from the precise nature of the air metering. The timing of the air on/off is controlled by demand, thus no allowance for the delay in pressure build up is required. The valve can be set during manufacture to give exactly the required amount of air.

The electronics provided for controlling the air supply needs only to cope with the occasional start/stop. This requiring only a rudimentary control system such as a solenoid to switch off the air for occasional maintenance, the valve will control the air flow even if the power to the machine is switched off. A rapid response time is not required, therefore, a less durable, more economical choice of pilot valve can be used without fear of failure.

A separate receiver can be dispensed with as the ram, on which the punch is mounted, and some of the pipe work, once modified, can act as the air receiver for the valve.

BRIEF DESCRIPTION OF THE DRAWINGS

An embodiment of the present invention is described below with reference to the accompanying drawings, in which:

FIGS. 1–5 are sequential views through the apparatus showing its operation as described below.

SPECIFIC DESCRIPTION

Figures 1, 2, 3, 4, 5:
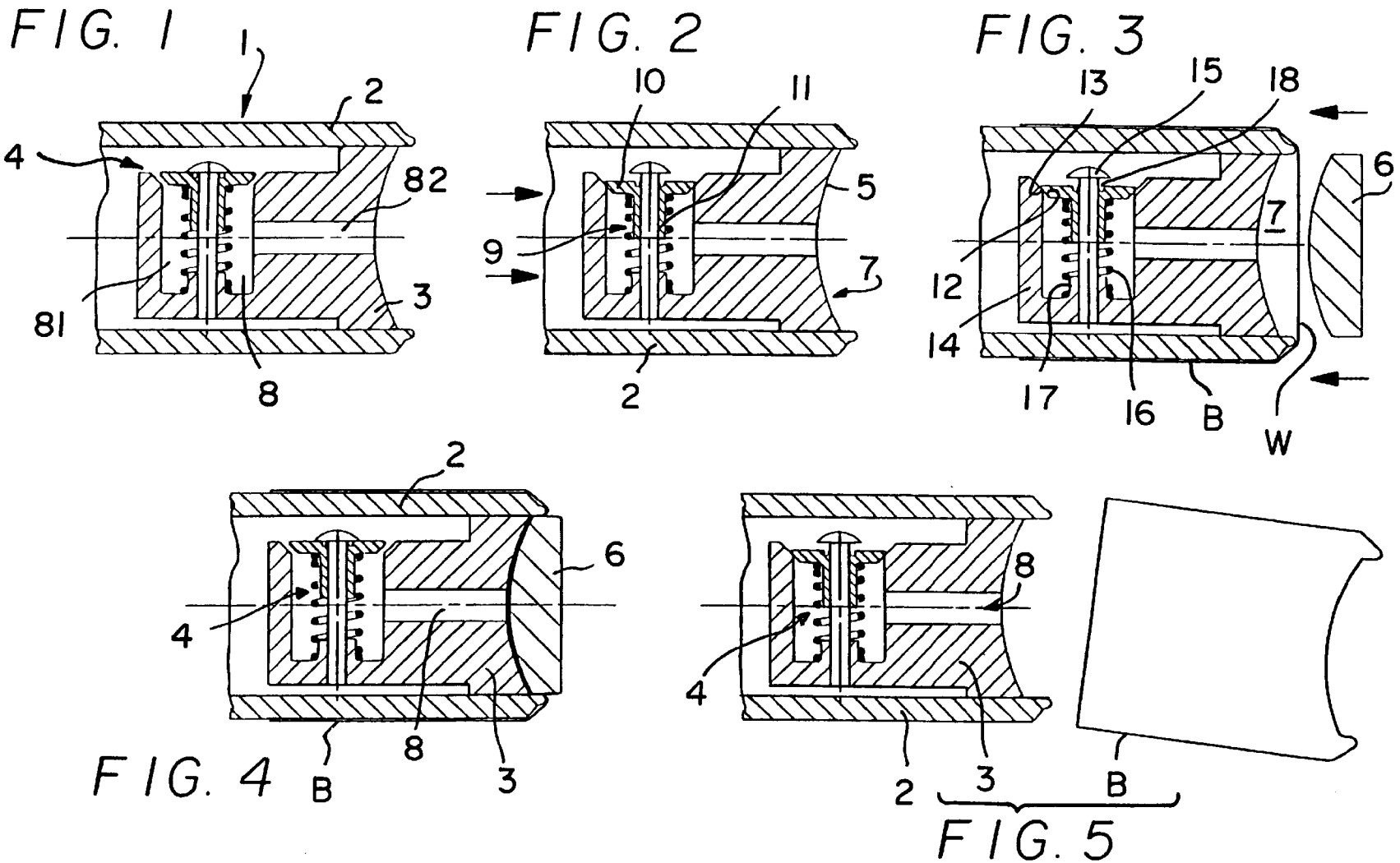
FIG. 1 is a vertical cross section through a punch shown in an initial position in which the apparatus is dormant.
FIG. 2 is a view similar to that of FIG. 1, in which the valve has been closed by the passage of air therethrough.
FIG. 3 is a view through the punch showing a can body which has been formed thereon and part of a doming tool.
FIG. 4 is a view similar to that of FIG. 1 showing the doming tool entering the recess in the punch to form the base profile of the can body and causing the valve to be opened.
FIG. 5 is a further view showing the can body stripped from the punch and the valve again closed by the passage of air.

As can be seen from the drawings, the apparatus comprises a punch 1 formed by a hollow sleeve 2 and a plug 3. As is well known, the punch will be mounted for reciprocation on the ram (not shown) of a can body-maker.

A valve 4 is mounted on the plug 3 and a supply of compressed air from a remote source (not shown) is connected to the interior of the sleeve 2. The exposed surface 5 of the plug 3 is concave and provides the die surface for the doming tool 6 which forms the domed base profile of the can body. The nose of the punch sleeve and the concave surface 5 provide a concave recess 7 in the nose of the punch, forming a complementary convex dome void for receiving the doming tool 6.

An air passage 8 provides fluid communication between the hollow interior of the punch sleeve 2 and the concave recess 7 and the valve 4 is located in the air passage. The air passage 8 consists of the cylindrical space 81 surrounding the valve poppet and a bore 82.

The valve 4 is a poppet valve having a poppet 9 formed with a disc shaped head 10 and a stem 11. The head 10 carries an annular sealing surface 12 which can seal against a corresponding and co-axial annular valve seat 13 formed in the valve housing 14. The stem 11 of the poppet 9 is mounted for axial sliding movement on a hardened steel guide pin 15, the axis of which is perpendicular to the axis of the punch to prevent the rapid axial reciprocation of the punch interfering with the dynamic operation of the valve.

The valve is biased into the open position shown in FIG. 1 by a spring 16 which surrounds the stem 11 and acts between the underside of the head 10 and a boss 17 located on the valve housing 14.

The poppet is formed from a flexible material such as a polyamide. A plastic material has been chosen for the valve poppet for two important reasons. The first is the need for the valve to conform to its seat 13 when sealed. Any slight misalignment of the valve or the ingress of foreign particulate would prevent a rigid valve from contacting its seat effectively. The second reason for choosing a plastic material is the ability to form a flexible lip seal at the upper end of the bore of the stem 11. A lip seal groove 18 can be machined directly into the plastic thus avoiding the difficulties of including a separate seal in the valve; the seal is, therefore, integral. In order to avoid unacceptable friction at the guide pin seal, a graphite filled polyamide is preferred. The presence of the graphite makes the valve sealing lips self lubricating and alleviates some of the friction and wear which would otherwise occur in the plastic.

The operation of the apparatus is described below.

FIG. 1 shows the position where the body-maker machine is dormant and the supply of compressed air is switched off by a simple solenoid valve (not shown). In this condition, the valve is held open by the spring 16 as shown.

When the machine is in operation and the compressed air supply is switched on, air will flow from the interior of the punch through the passage 8 to atmosphere at the recess 7. The flow of air through the valve causes a pressure drop across the head with the lower pressure being on the downstream side of the valve head. The spring 16 is chosen in order to offer sufficient resistance to hold the valve open until a predetermined air flow rate is achieved. It should be noted that the valve is constructed such that it causes a restriction to the flow of air in the air passage 8 from the interior of the punch sleeve to the recess 7 resulting in a pressure drop across the valve which acts on the valve in the direction tending to close it.

The valve is essentially a flow control device, the essential function being to limit the flow throughput by sensing the pressure drop across a restriction built into the path of the flow. The control of the flow is achieved by the valve whose position (open or closed) is governed by the extent of pressure drop associated with that flow. The flow rate at which the valve closes can be controlled by adjusting the degree of restriction which it provides when in the open position or by adjusting the valve spring preload and rate. Additionally, the geometry of the valve is such that the restriction increases as the valve begins to close. This has the effect of rapidly accelerating the valve to the closed position. The increasing restriction means that, in terms of mass flow, there is a sharp point of demarcation where the valve shuts abruptly instead of it closing over a narrow range of increasing throughput. This conserves air and ensures that the valve is fully closed for the next stroke.

FIG. 2 shows the position where the flow of air through the valve has closed the valve. After this, the punch engages a drawn cup (not shown) which is to be further drawn and ironed on the punch. FIG. 3 shows the redrawn and ironed can body B located tightly on the outer surface of the punch sleeve 2 at the position just prior to engagement with the doming tool 6. In this position the recess 7 is covered by the bottom wall W of the can body. The valve 4 remains held closed by the air pressure in the interior of the punch sleeve upstream of the valve. Complete closure of the valve is essential since any leakage through the valve during the drawing process would lead to pressurisation of the dome void which would open the valve as the pressures equalised from one side to the other. The resulting premature air supply would blow the can through the remaining dies before it had been ironed to the correct height.

When the doming tool 6 enters the recess 7 to form the domed profile of the base of the can body, the air contained in the recess is compressed into the air passage 8. This causes a raising of the air pressure in the valve housing 14 which combined with the effect of the spring 16 is sufficient to open the valve 4. It will be appreciated that a substantial rise in pressure in the passage will be required and it is therefore necessary for the volume of the air passage 8 between the valve and the recess 7 and the volume of the recess itself to be such that entry of the tool 6 into the recess 7 will generate such a substantial rise.

Opening of the valve connects the compressed air in the interior of the punch sleeve to the recess 7 through the passage 8 and helps to strip the can body from the punch. Mechanical stripping means will also be provided. As the can body is stripped from the punch it is filled with compressed air. A slight back pressure maintains the valve 4 open until the can body is clear of the punch. At this point, shown in FIG. 5, the passage 8 is vented to atmosphere and the mass flow rate through the valve 4 increases to the level which closes the valve 4. After the ram has retracted completely, the next cycle begins again from FIG. 2.

I claim:

1. Apparatus for use in forming can bodies comprising:

a punch including a hollow punch sleeve;

a supply of compressed air connected to the interior of the punch sleeve;

a concave recess in the nose of the punch adapted to receive a complementary shaped doming tool for forming a domed base profile in the can body;

an air passage providing fluid communication between the interior of the punch sleeve and the concave recess; and a valve located in the air passage; the valve being biased into the open position;

wherein the volume of the air passage between the valve and the recess and the volume of the recess are such that entry of the doming tool into the recess when the valve is closed will cause a substantial rise in pressure in the air passage between the valve and the recess; and wherein the valve is constructed such that it causes a restriction to the flow of air in the air passage from the interior of the punch sleeve to the recess resulting in a pressure drop across the valve which acts on the valve in the direction tending to close the valve.

2. Apparatus as claimed in claim 1, wherein the valve is a poppet valve and the poppet has a disc shaped head carrying an annular sealing surface for sealing against a corresponding and co-axial annular valve seat.

3. Apparatus as claimed in claim 2, wherein the axis of the valve is perpendicular to the axis of the punch.

4. Apparatus as claimed in claim 2, wherein the head of the valve is mounted on a stem and the poppet thus formed is supported for axial sliding movement on a guide pin.

5. Apparatus as claimed in claim 4, wherein the poppet is made of a flexible material and is formed with a flexible lip seal in the face of the poppet head surrounding the guide pin.

6. Apparatus as claimed in claim 4, wherein a spring surrounding the poppet stem and acting on the poppet head biases the valve into the open position.

7. Apparatus as claimed in claim 2, wherein the poppet is formed of a graphite filled polyamide.

8. Apparatus as claimed in claim 1, wherein the punch sleeve is substantially closed adjacent the nose of the punch by a plug having a concave surface which provides a die surface for the doming tool and which partially defines the concave recess, wherein the valve is mounted to the plug and wherein the air passage from the interior of the punch sleeve extends through the valve and the plug to the concave recess.

* * * * *